US005286168A

United States Patent [19]

Smith

[11] Patent Number: 5,286,168

[45] Date of Patent: Feb. 15, 1994

[54] FREESTANDING MIXED TUNED BLADE

[75] Inventor: M. Lawrence Smith, Orlando, Fla.

[73] Assignee: Westinghouse Electric Corp., Pittsburgh, Pa.

[21] Appl. No.: 829,133

[22] Filed: Jan. 31, 1992

[51] Int. Cl.[5] ..... F01D 5/16

[52] U.S. Cl. ..... 416/193 A; 416/203; 416/220 R; 416/223 A; 416/500

[58] Field of Search ..... 416/193 A, 219 R, 220 R, 416/223 A, 500, DIG. 2, DIG.5, 203

[56] References Cited

U.S. PATENT DOCUMENTS

| | | | |
|---|---|---|---|
| 1,456,085 | 5/1923 | Wilkinson | 416/179 |
| 3,986,793 | 10/1976 | Warner et al. . | |
| 4,097,192 | 6/1978 | Kulina | 416/500 |
| 4,676,723 | 6/1987 | Kiger et al. | 416/193 A |
| 4,714,410 | 12/1987 | Hancock | 416/193 A |
| 4,767,275 | 8/1988 | Brown . | |
| 4,878,810 | 11/1989 | Evans | 416/500 |
| 4,919,593 | 4/1990 | Brown . | |
| 5,088,894 | 2/1992 | Patel | 416/219 R |
| 5,160,242 | 11/1992 | Brown | 416/193 A |

FOREIGN PATENT DOCUMENTS

| | | | |
|---|---|---|---|
| 8412 | 1/1986 | Japan | 416/219 R |

*Primary Examiner*—Edward K. Look
*Assistant Examiner*—James A. Larson

[57] ABSTRACT

Freestanding rotor blades are mixed tuned by varying the dimensions of the blades at two locations. First, a profiled tip includes a machined-out strip, having a height which can be varied to achieve the desired tuning effect. The longer or deeper the profile, the higher the frequency will become. This tuning technique is used in conjunction with a broadened base section. Blades having a shorter profile tip are machined beginning at the base section, so as to remove enough mass from between the base section and a next upper section to provide the desired tuning effect. The lower frequency blade has a thinner base section and a shorter profile tip.

5 Claims, 5 Drawing Sheets

FREESTANDING MIXED TUNED BLADE

BACKGROUND OF THE INVENTION

1. Field of the Invention

The present invention relates generally to steam turbine rotor blades and, more specifically, to a freestanding blade design for a row of rotating blades mounted on a turbine rotor, in which alternating blades have differently tuned natural frequencies.

2. Description of the Related Art

Steam turbine rotor blades are arranged in a plurality of rows or stages. The rotor blades of a given row are normally identical to each other and mounted in a mounting groove provided in the turbine rotor.

Turbine rotor blades typically share the same basic shape. Each has a root receivable in the mounting groove of the rotor, a platform which overlies the outer surface of the rotor at the upper terminus of the root, and an airfoil which extends upwardly from the platform.

The airfoils of most steam turbine rotor blades include a leading edge, a trailing edge, a concave surface, a convex surface, and a tip at the distal end opposite the root. The airfoil shape common to a particular row of rotor blades differs from the airfoil shape for every other row within a particular turbine. Likewise, no two turbines of different designs share airfoils of the same shape. The structural differences in airfoil shape result in significant variations in aerodynamic characteristics, stress patterns, operating temperature, and natural frequency of the airfoil. These variations, in turn, determine the operating life of the rotor blades within the boundary conditions (turbine inlet temperature, pressure ratio, and engine speed), which are generally determined prior to the airfoil shape development.

Development of a turbine section for a new commercial, power generation stream turbine may require several years to complete. When designing rotor blades for a new steam turbine, a profile developer is given a certain flow field with which to work. The flow field is determined by the inlet and outlet angles (for steam passing between adjacent rotor blades of a row), gauging, and the velocity ratio, among other things. "Gauging" is the ratio of throat to pitch; "throat" is the straight line distance between the trailing edge of one rotor blade and the vacuum side surface of an adjacent blade, and "pitch" is the distance between the trailing edges of the adjacent rotor blades.

These flow field parameters are dependent on a number of factors, including the length of the rotor blades of a particular row. The length of the blades is established early in the design stages of the steam turbine and is essentially a function of the overall designed power output of the steam turbine and the power output for that particular stage.

Blades of a given row may be "freestanding", meaning that individual blades of a row are not connected to each other, they may be lashed or shrouded together in groups.

An essential aspect of the rotor blade design is the "tuning" of the natural frequency of the rotor blade so as to avoid natural frequencies which coincide with or approximate the harmonics of running speed. Such coincidence causes the blades to vibrate in resonance, thereby leading to blade failure. Therefore, in the process of designing and fabricating turbine rotor blades, it is critically important to tune the resonant frequencies of the blades to minimize forced or resonant vibration.

To do this, the blades must be tuned to avoid the "harmonics of running speed". The harmonics of running speed is best explained by example. In a typical fossil fuel powered steam turbine, the rotor rotates at 3,600 revolutions per minute (rpm), or 60 "cycles" per second (cps). Since one cps equals 1 hertz (Hz), and since simple harmonic motion can be described in terms of the angular frequency of circular motion, the running speed of 60 cps produces a first harmonic of 60 Hz, a second harmonic of 120 Hz, a third harmonic of 180 Hz, a fourth harmonic of 240 Hz, etc. The harmonic series of frequencies, occurring at intervals of 60 Hz, represent the characteristic frequencies of the normal modes of vibration of an exciting force acting upon the rotor blades. If the natural frequencies of oscillation of the rotor blades coincide with the frequencies of the harmonic series, or harmonics of running speed, a destructive resonance can result at one or more of the harmonic frequencies.

Given that exciting forces can occur at a series of frequencies, a blade designer must ensure that the natural resonant frequencies of the blades do not fall on or near any of the frequencies of the harmonic series. This would be an easier task if rotor blades are susceptible to vibration in only one direction. However, a rotor blade is susceptible to vibration in potentially an infinite number of directions. Each direction of vibration will have a different corresponding natural frequency. The multidirectional nature of blade vibration is referred to as the "modes of vibration". Each mode of vibration establishes a different natural resonant frequency for a given rotor blade for a given direction.

Keeping in mind the harmonic series described above for a fossil fuel powered steam turbine operating at 3,600 rpm the natural resonant frequency for a rotor blade must be tuned to avoid frequencies at intervals of 60 Hz. For example, the second harmonic occurs at 120 Hz and the third harmonic occurs at 180 Hz. The standard practice is to attempt to tune the blade having a frequency falling somewhere between 120–180 Hz to come as close as possible to the mid point between the two harmonics, i.e., 150 Hz. If a rotor blade has a natural resonant frequency which falls between the second and third harmonics for the first mode of vibration, it would be desirable to tune the blade to have a frequency at or near 150 Hz for the first mode of vibration.

Frequencies for other modes of vibration are similarly tuned to be as close as possible to a midpoint between two successive harmonics. However, frequency tests are commonly run up to and beyond a seventh mode of vibration; a frequency near the seventh harmonic (420 Hz) might be expected.

When a new steam turbine is designed, the blade designer must tune the turbine blades so that none of the resonant frequencies for any of the modes of vibration coincide with the frequencies associated with the harmonics of running speed. Sometimes, tuning requires a trade off with turbine performance or efficiency. For instance, certain design changes may have to be made to the blade to achieve a desired natural frequency in a particular mode. This may necessitate an undesirable change elsewhere in the turbine such as a change in the velocity ratio or a change in the pitch and Width of the blade root.

As previously mentioned, the rotor blades of a given row are identical. But, to avoid certain aerodynamic problems, such as aeroelastic instability, where two adjacent blades having the same natural frequencies can excite each other, a method of mix-tuning is used. This method provides that two adjacent blades will have differing natural frequencies thus preventing aeroelastic instability. This method is achieved using two different profile tip lengths on adjacent blades in a row.

Westinghouse Electric Corporation, the Assignee of the present application, makes numerous different steam turbines which can be identified by their building block (BB) numbers. A BB70, for example, will have individual rows of stationary and rotating blades identified by their respective positions vis-a-vis the steam inlet. The L-2R row is the second row of rotating blades from the steam exit. Blade length progressively increases as distance from the inlet increases. The BB70 L-2R row has 136 blades per row, while the BB71 has 154 blades per row.

Side entry root/group configurations are commonly used to attach the blade of a given row to the rotor. Straight side entry root/groove configurations are characterized by a linear root center line, while curved side entry configurations have arcuate root center lines. Depending on the type of root, special mounting problems arise, particularly when installing the last blade of a row.

The blade currently used in the L-2R row of the BB70 and BB71 turbines has shrouded tips and is mounted on a straight side entry root/groove configuration. The blades are locked together at the shrouds, and thus a platform-to-platform locking pin is not required.

If it becomes necessary to retrofit an existing turbine with freestanding blades, or to replace original designed shrouded blades with freestanding blades, a problem arises with respect to mounting and locking together the last blade of a row. Platform-to-platform pinning, as described in U.S. Pat. No. 4,767,275 issued to Brown, is suitable for curved side entry blades, but has not heretofore been used for freestanding straight side entry blades.

BRIEF DESCRIPTION OF THE DRAWINGS

FIG. 1(*a*) is an enlarged sectional view taken along line PT—PT of FIG. 1;

DETAILED DESCRIPTION OF THE PREFERRED EMBODIMENTS

Figure 1:
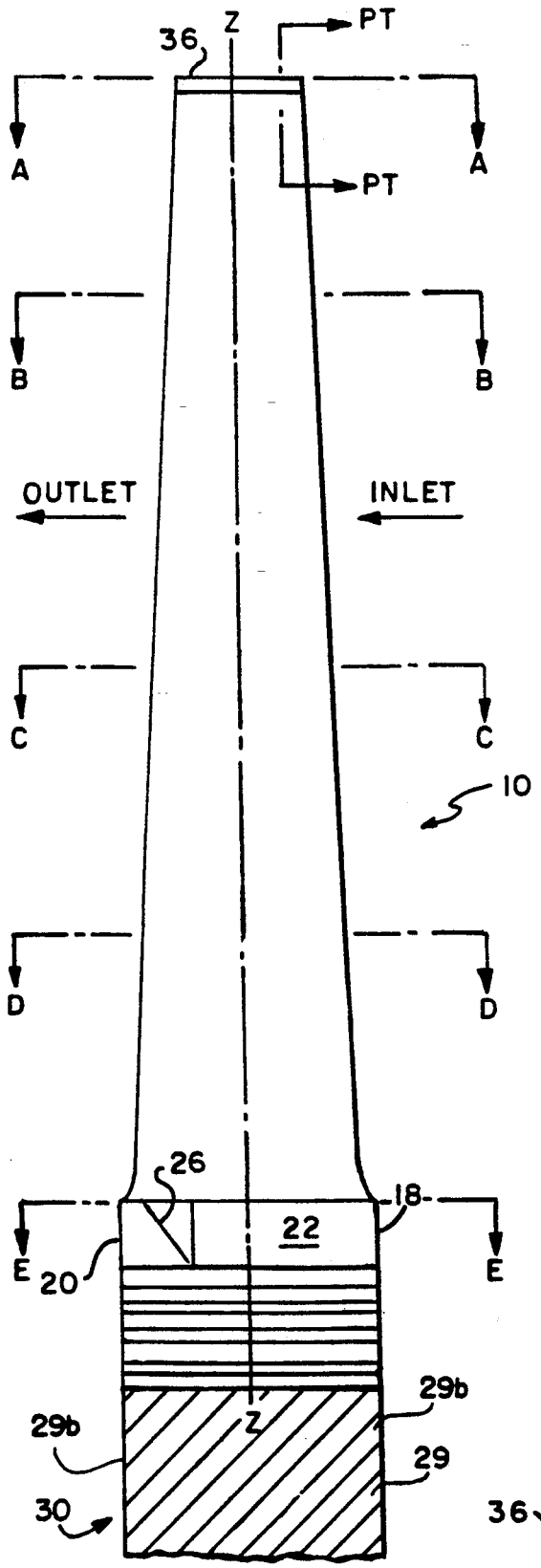
FIG. 1 is a tangential view of a turbine blade according to the present invention.
Figure 2:
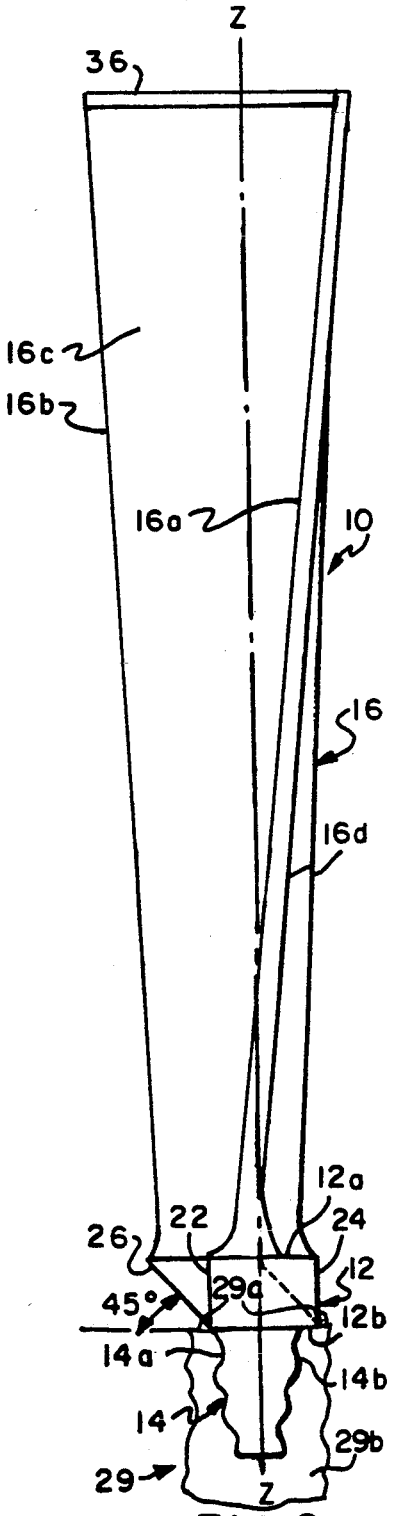
FIG. 2 is an axial view of the turbine blade of FIG. 1.

Referring to FIGS. 1 and 2, a rotating blade for a steam turbine is generally referred to by the numeral 10 and includes a platform portion 12 having a generally rectangular shape including an upper surface 12*a* and a lower surface 12*b*. A straight side-entry root portion 14 is of the "fir-tree" style having a plurality of necks 14*a* of decreasing width from uppermost to lowermost, and a plurality of lugs 14*b* which also diminish in width from uppermost to lowermost. The blade itself is made of metal as a one piece integrally formed structure. The root portion 14 extends downwardly from the lower surface 12*b* of the platform portion 12. A plane encompassing the lower surface 12*b* of the platform portion 12 demarcates the root and platform portions.

A freestanding airfoil portion 16 extends upwardly from the upper surface 12*a* of the platform portion 12, in a direction opposite that of the root portion 14. A longitudinal axis, Z—Z, of the blade passes through the center of the blade.

The airfoil portion 16 has a leading edge 16*a*, a trailing edge 16*b*, a concave pressure side surface 16*c* and a convex, suction side surface 16*d*. The airfoil portion 16 has an overall length of 10.714 inches (272.1356 mm), and was designed to be applicable in several different blade path combinations in both the BB70 and BB71 turbines.

Figure 3:
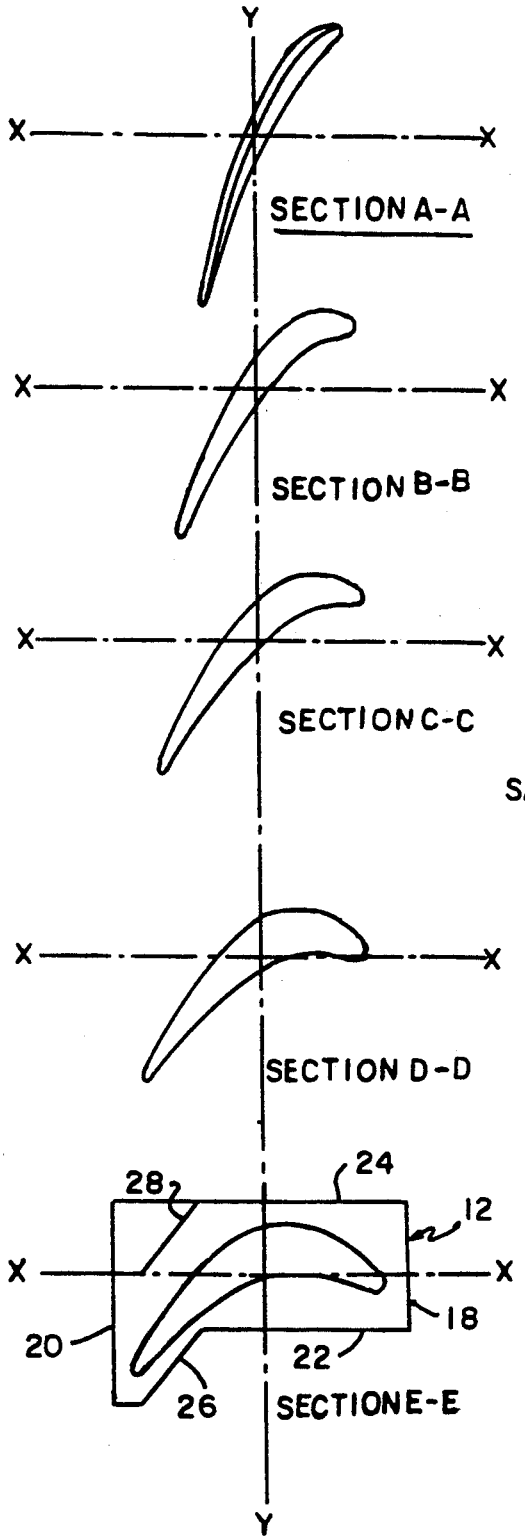
FIG. 3 is a plot showing sections A—A through E—E of FIG. 1, on an X and Y coordinate plotting system, in which the intersection of the X and Y axes defines a Z axis.
Figure 4:
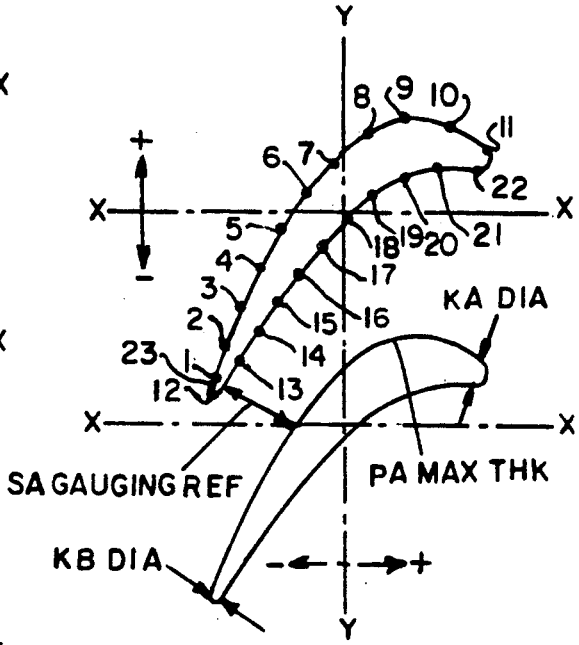
FIG. 4 is a plot showing two adjacent blades through a typical section, and showing twenty-two basic coordinate points for defining the shape of the blade sections.

FIG. 3 is a plot of the airfoil sections A—A through E—E of FIG. 1. FIG. 4 is a plot showing two adjacent blades of a row at a typical section, and illustrating twenty-two reference points along the surface of the blade. These points can be identified by coordinate points on X and Y axes so that the shape of the curve can be quantified according to the following tables:

BASIC BLADE SECTION COORDINATE POINTS

| Section | 1 | 2 | 3 | 4 | 5 | 6 | 7 | 8 | 9 | 10 | 11 |
|---|---|---|---|---|---|---|---|---|---|---|---|
| | | | | | CONVEX HORIZONTAL | | | | | | |
| A-A | −.5570 | −.4860 | −.4150 | −.3540 | −.2870 | −.2110 | −.1190 | −.0020 | −.1460 | .3440 | .6790 |
| B-B | −.7050 | −.6743 | −.5400 | −.4480 | −.3460 | −.2290 | −.0940 | −.0690 | −.2770 | .5290 | .9030 |
| C-C | −.8240 | −.7310 | −.6300 | −.5170 | −.3860 | −.2340 | −.0570 | −.1540 | −.4010 | .6630 | .9000 |
| D-D | −.9740 | −.9610 | −.7330 | −.5850 | −.4160 | −.2230 | −.0030 | −.2500 | −.5190 | .7660 | .9730 |
| E-E | −1.1010 | −.9613 | −.8019 | −.6187 | −.4108 | −.1761 | −.0881 | −.3690 | −.6387 | .9737 | 1.0728 |
| | | | | | CONVEX VERTICAL | | | | | | |
| A-A | −1.3910 | −1.1280 | −.9690 | −.6090 | −.3490 | −.0520 | .1600 | .4010 | .6250 | .8050 | .9260 |
| B-B | −1.1910 | −.9410 | −.6950 | −.4530 | −.2150 | −.0160 | .2370 | .4390 | .5940 | .6540 | .5460 |
| C-C | −1.0670 | −.8160 | −.5730 | −.3360 | −.1070 | −.1070 | .3020 | .4590 | .5470 | .5240 | .3560 |
| D-D | −.9150 | −.6640 | −.4280 | −.2030 | −.0060 | −.1930 | .3470 | .4390 | .4390 | .3340 | .1280 |

-continued

| BASIC BLADE SECTION COORDINATE POINTS | | | | | | | | | | | | |
|---|---|---|---|---|---|---|---|---|---|---|---|---|
| E-E | −.7774 | −.5245 | −.2921 | −.0778 | −.1125 | −.7688 | .3671 | .3763 | .3763 | .1362 | .0921 | |
| Section | 12 | 13 | 14 | 15 | 16 | 17 | 18 | 19 | 20 | 21 | 22 | 23 |
| | | | | | CONCAVE HORIZONTAL | | | | | | | |
| A-A | −.5570 | −.4120 | −.3240 | −.2350 | −.1430 | −.0470 | .0560 | .1680 | .2940 | .4460 | .6780 | — |
| B-B | −.7050 | −.5480 | −.4450 | −.3380 | −.2770 | −.1090 | .0190 | .1600 | .3190 | .5080 | .8030 | — |
| C-C | −.8240 | −.6510 | −.5300 | −.4030 | −.2770 | −.1280 | .0250 | .1940 | .3830 | .5930 | .9000 | — |
| D-D | −.9740 | −.7850 | −.6420 | −.4900 | −.3290 | −.1570 | .0380 | .2310 | .4450 | .6640 | .9730 | — |
| E-E | −1.1010 | −.8931 | −.7268 | −.5469 | −.3527 | −.1445 | .0764 | .3054 | .5353 | .7590 | 1.0728 | — |
| | | | | | CONCAVE VERTICAL | | | | | | | |
| A-A | −1.5620 | −1.1710 | −.9370 | −.7040 | −.4710 | −.2400 | −.0130 | .2110 | .4270 | .6250 | .7990 | −1.4248 |
| B-B | −1.3240 | −1.0100 | −.8120 | −.6170 | −.4230 | −.2340 | −.0510 | .1220 | .2770 | .3960 | .4290 | −1.2256 |
| C-C | −1.1780 | −.9040 | −.7210 | −.5430 | −.3690 | −.2020 | −.0450 | .0840 | .2050 | .2670 | .2320 | −1.1024 |
| D-D | −1.0100 | −.7670 | −.6010 | −.4430 | −.2940 | −.1590 | −.0440 | .0420 | .0900 | .0890 | −.0020 | −.9504 |
| E-E | −.8673 | −.6336 | −.4741 | −.3301 | −.2061 | −.1074 | −.0420 | .0162 | −.0323 | .0874 | −.2292 | −.8144 |

Once the basic airfoil sections are defined according to the foregoing tables, spline interpolation is used in a known manner to define the surface of the blade from section to section.

Also, FIG. 4 illustrates certain other blade measurements, including the leading edge diameter (KA), the trailing edge diameter (KB), gauging, and section maximum thickness (PA). The values for the aforementioned measurements are listed below in Table I as follows:

TABLE I

| Section | KA DIA | KB DIA | PA THK | SA GAUGING |
|---|---|---|---|---|
| A-A | .143 | .060 | .241 | .339 |
| B-B | .158 | .060 | .289 | .449 |
| C-C | .146 | .061 | .330 | .489 |
| D-D | .143 | .059 | .379 | .541 |
| E-E | .139 | .060 | .421 | .504 |

As previously mentioned, the airfoil portion 16 has an overall length of 10.714 inches. Thus, with the E—E or base section as the beginning point, the D—D section is 2.58 inches (65.532 mm) from the E—E section; the B—B section is 7.66 inches (194.564 mm) from the E—E section; and the A—A section is 10.714 inches from the E—E section. The platform has a height of 0.62 inches and the root portion has a height of about 1.206 inches.

The platform portion 12 has a steam inlet side 18, a steam outlet side 20, a first end 22 on the concave, pressure side of the airfoil portion at the base section E—E and a second end 24 on the convex, suction side of the airfoil portion at the base section E—E. The two ends 22 and 24 and the two sides 18 and 20 define a substantially rectangular platform portion 12 from which the root portion 14 and airfoil portion 16 extend in opposite directions. At the steam outlet side 20 of the platform portion, a wing 26 extends outwardly to support the trailing edge **16*b* of the airfoil portion 16** at the base section E—E.

Figure 5:
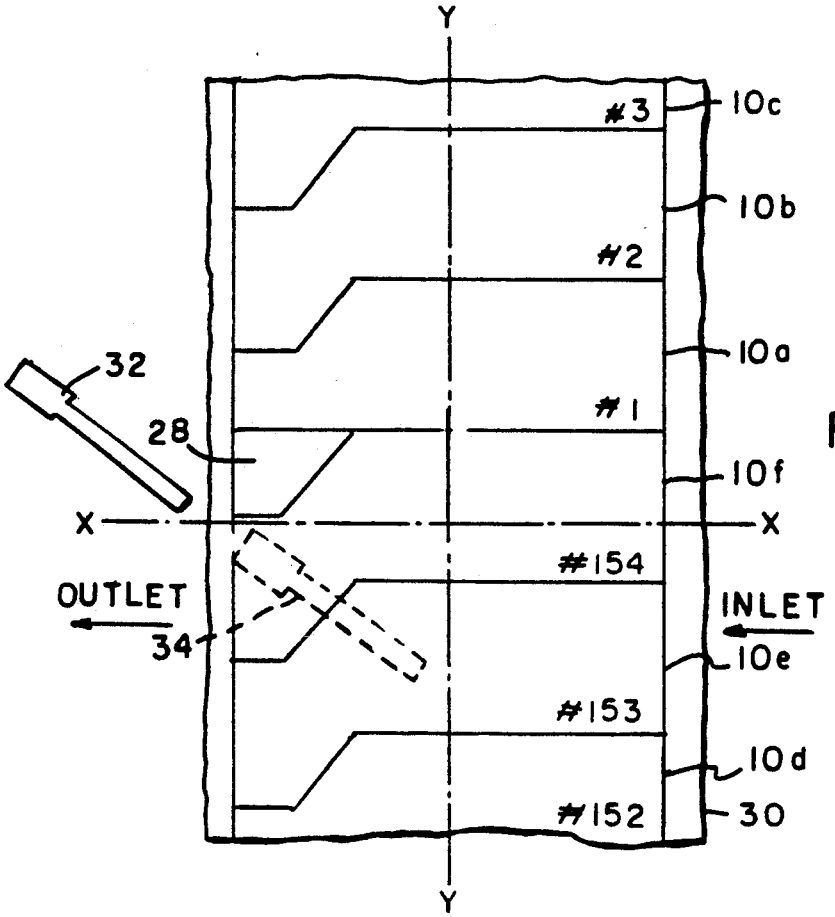
FIG. 5 is an enlarged plan view showing a section of a blade row, with only the platforms illustrated, according to the present invention.

A corresponding cut-out 28 is provided on the opposite end of the platform portion 12. The wing 26 of one blade fits into the cut-out 28 of an adjacent blade. Because of the wing 26 and the fact that the root portion is a straight side-entry type, a difficult problem with respect to assembling the blades in corresponding rotor grooves was experienced. The problem was solved according to the present invention by providing a unique first blade of the row which allows the closing blade to be inserted into the row. Referring to FIG. 5, the platform portions of several adjacent blades are illustrated. Since blades are usually installed on the inlet side, and because of the fact that the present blade employs a straight side-entry root, the blades must be installed from the opposite side, contrary to the usual practice. Thus, in FIG. 5, the first blade installed, designated by the numeral **10*a*, is installed from the outlet side, or from left to right in FIG. 5, so as to be mounted in a corresponding mounting groove of a conventional disc 29 of the rotor 30. The disc 29 includes a cylindrical upper surface 29*a* and parallel annular flat sides 29*b***.

FIG. 5 is a somewhat simplified view for the purpose of illustrating how the closing blade fits into the row. Numeral **10*b* refers to the second blade of the row, numeral 10*c* refers to the third blade of the row, numeral 10*d* refers to the 152nd blade of the row and numeral 10*e* refers to the 153rd blade of the row. The closing blade 10*f* must fit between the first blade of the row 10*a* and the immediately preceding blade 10*e*, and for that purpose, the standard platform shape, having a wing on one side and a recess on the other, would not permit an inlet-side-entry insertion of the closing blade 10*f* into its corresponding mounting groove. Thus, in order to facilitate installation of the last or closing blade 10*f*, the first blade 10*a* has a different platform, in which there is no wing provided on the end of the platform adjacent to the closing blade 10*f*. Thus, the cut-out 28 of the closing blade 10*f* does not receive a corresponding wing from the adjacent first blade 10*a***.

A locking pin 32 is received in a corresponding bore 34 which passes through the 154th blade **10*f* and its immediate preceding blade 10*e* to thus provide a locking device once the last blade 10*f*** is installed.

Another aspect of the present invention is that the row of blades are "mixed tuned" in that, of the 154 blades of the row, half of them have one set of natural frequencies while the other half have a different natural frequency. The frequency differences are not substantial, in terms of the absolute values, but the fact that the row is "mixed tuned" will help eliminate certain aerodynamic problems, such as aeroelastic instability. Generally, it is desirable to position the resonant frequencies midway between the harmonics of the running speed. The is, the rotating blade has a resonant frequency in a first vibratory mode, corresponding to a tangential vibration in a rotational direction of the rotor on which the blade is mounted when the rotor is operated at a running speed, which is substantially between a third and fourth harmonic of the running speed, and this blade has a resonant frequency in a second vibratory mode, corresponding to a vibration in an axial direction of the rotor when the rotor is operated at the running speed, which is substantially midway between a seventh and eighth harmonic of the running speed. For example, the first mode vibratory frequencies are likely to fall between the third and fourth harmonics, or between 180 and 240 Hz. Thus, to avoid resonant frequency, the blade should be tuned in-between the two harmonics, such as around 210 Hz. With this target in mind, the blades of the present invention may be tuned such that there is as little as a 4 or 5 Hz difference between the two blade types so that, for example, half of the blades may have a frequency of 208 and the other half may have a frequency of 212.

With reference to FIG. 5, the odd numbered blades would have one frequency while the even numbered blades would have the other frequency.

Figure 1A:
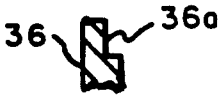

In order to mix tune the blades according to the present invention, the blade dimensions are varied at two locations. First, the profiled tip 36, as shown in FIGS. 1, 1*a* and 2, is longer (or deeper) for the blades having a higher frequency. As shown in FIG. 1*a*, the tip 36 has a machined-out strip 36*a*, having a height which can be varied to achieve the desired tuning effect. The longer or deeper the profile, the higher the frequency will become.

This tuning technique is used in conjunction with a broadened base section, section E—E, so as to further lower the frequency. This tuning technique can be implemented by forging and machining all of the blades to achieve the dimensions realized according to the tables of coordinate points listed above, while the blades having a shorter profile tip can be machined beginning at the base section, without changing the overall shape of the blade, so as to remove enough mass from between the base section E—E and section D—D to provide the desired tuning effect. Thus, the lower frequency blade will have a thinner base section and a shorter profile tip.

Figure 6:
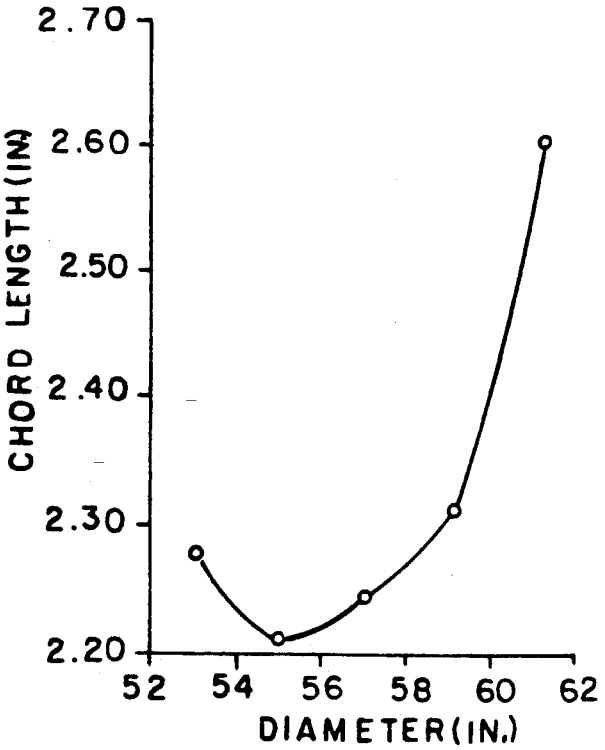
FIG. 6 is a chart showing a relationship between chord length and length of the blade according to the present invention.

Other unique aspects of the present invention are manifest by a unique progression of chord length which is illustrated in FIG. 6. FIG. 6 is a graph showing the chord length plotted against the length of the blade. The blade length refers to the 10.714 inch height of the airfoil section E—E. At the base section, the blade airfoil has no height, but the starting point of 53 inches refers to the diameter of the rotor including the platform portion of the blade. The D—D section is 2.58 inches from the base section to give a length of 55.58 inches including the rotor and platform. FIG. 6 is significant because it shows that the chord length increases throughout most of the length of the blade. This is an unusual phenomenon in the blade art and in fact is believed to be the first freestanding turbine rotor blade to have an increase in chord length towards the outer sections of the blade.

Figure 7:
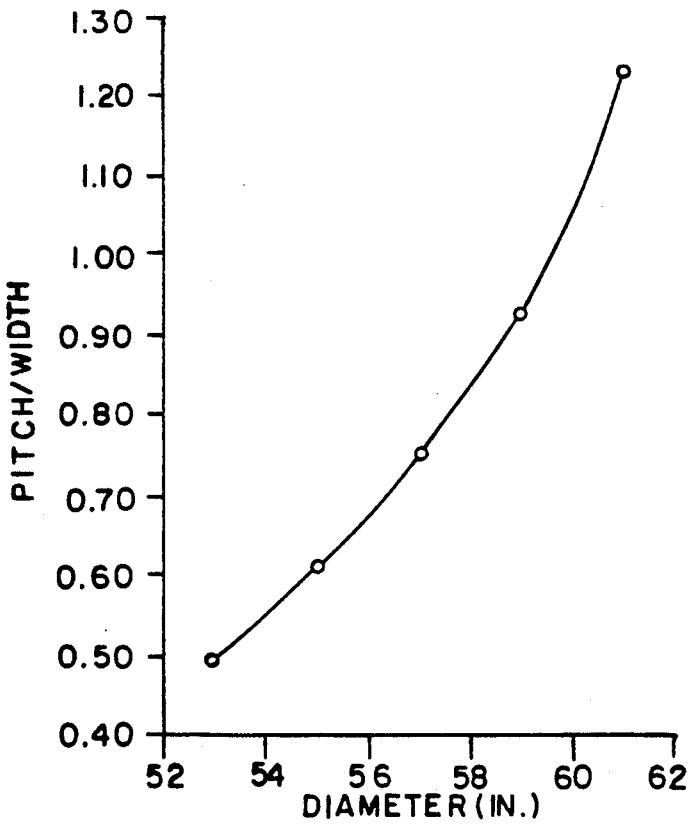
FIG. 7 is a chart showing the relationship of the ratio of pitch to width, in relation to blade length.
Figure 8:
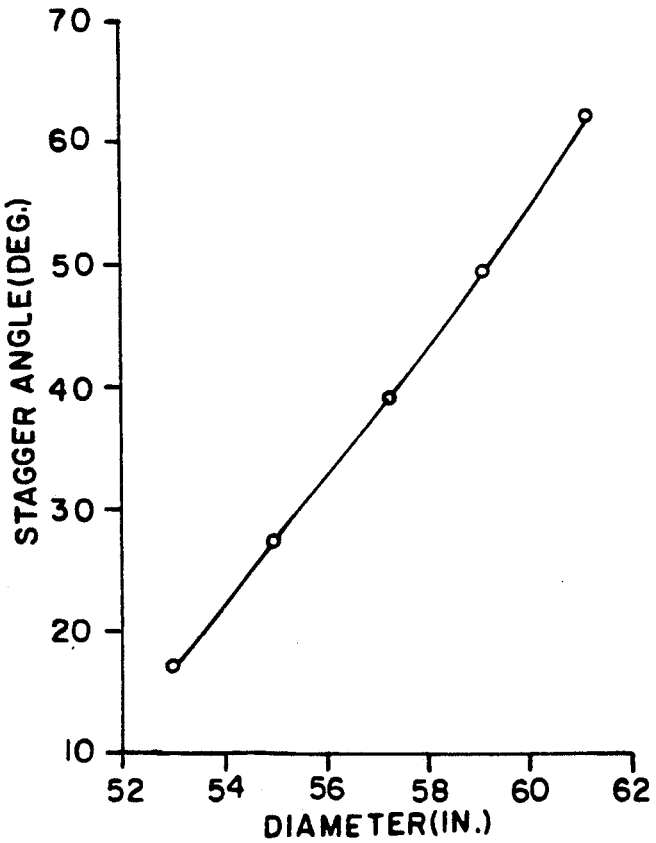
FIG. 8 is a chart showing the relationship of stagger angle, in relation to blade length.

FIGS. 7 and 8 illustrate pitch to width ratios for the different blade sections, and the stagger angle for each blade section. These are believed to be uniquely associated with the blade according to the present invention.

Figure 9:
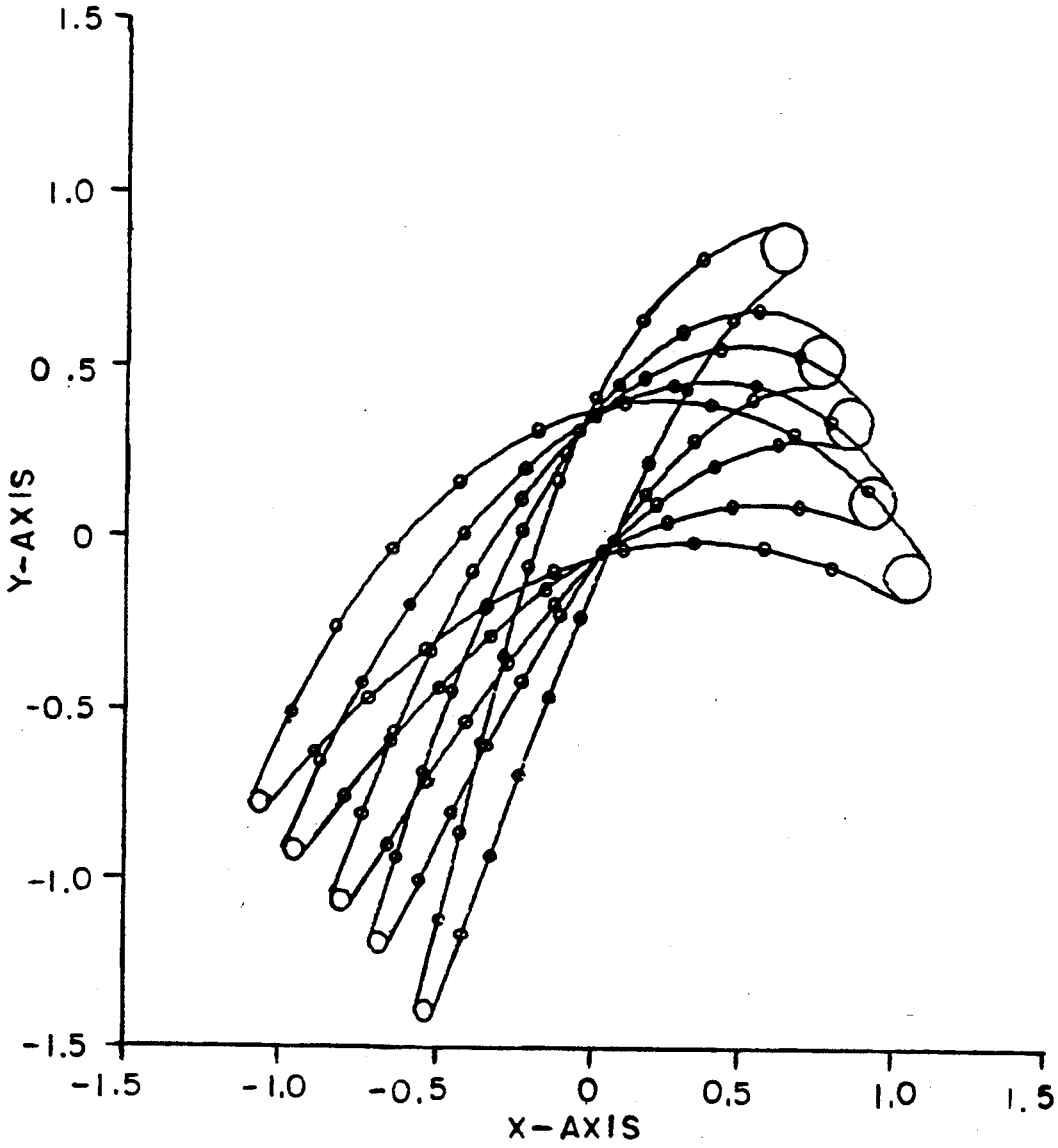
FIG. 9 is a stacked plot of the various sections A—A through E—E, juxtaposed onto an X and Y axis coordinate system, and illustrating the position of the twenty-two basic coordinate points along the outer surfaces of the various sections.

FIG. 9 illustrates a stacked plot showing the various sections A—A through E—E juxtaposed onto an X—X, Y—Y coordinate system. The coordinate points for the various blade sections correspond in number to the coordinate points illustrated in FIG. 4, with respect to the uppermost blade section. The circles illustrated at the leading and trailing edges of the blade sections merely show the radius of the leading and trailing edges at each section.

Numerous modifications and adaptations of the present invention will be apparent to those skilled in the art and thus, it is intended by the following claims to cover all such modifications and adaptations which fall within the true spirit and scope of the invention.

What is claimed is:

1. Rotating blades for a steam turbine comprising:

first and second blades, each having a platform portion with upper and lower surfaces;

a straight side-entry root portion extending downwardly from the lower surface of the platform position; and a freestanding airfoil portion extending upwardly from the upper surface of the platform portion;

wherein the airfoil portion has a leading edge, a trailing edge, a concave pressure side, a convex suction side, a base section and a tip section, wherein the base section of the second blade has an airfoil maximum thickness dimension that is less than an airfoil maximum thickness dimension of the base section of the first blade, and wherein the tip section of the first and second blades has a profile and the profile of the second blade is shorter in the longitudinal direction of the blade than a profile of the first blade, wherein the first and second blades have a resonant frequency in a first vibratory mode, corresponding to a tangential vibration in a rotational direction of a rotor on which the first and second blades are to be mounted when the rotor is operated at a running speed, which is substantially between a third and fourth harmonic of the running speed, and the first and second blades have a resonant frequency in a second vibratory mode, corresponding to a vibration in an axial direction of the rotor when the rotor is operated at the running speed, which is substantially midway between a seventh and eighth harmonic of the running speed.

2. Rotating blades according to claim 1, wherein a chord connecting the leading edge and trailing edge at each section of the airfoil portion increases for most of the length between the base section and the tip section.

3. A rotor blade stage of a turbine having a rotor, comprising:

a disk constituting a portion of the rotor and being coaxial with the rotor, and having a cylindrical upper surface and two parallel annular flat side surfaces disposed orthogonally to the rotor axis;

a plurality of straight mounting grooves disposed at equidistant intervals around the disk, each being formed in the cylindrical upper surface of the disk and extending from one side surface of the disk to the other and being oriented parallel to the rotor axis;

a plurality of first rotor blades, including a starting blade, each first blade having a platform portion with upper and lower surfaces, a straight side-entry root portion extending downwardly from the lower surface of the platform portion and mounting the plurality of first rotor blades in every other one of the mounting grooves, and a freestanding airfoil portion extending upwardly from the upper surface of the platform portion, the airfoil portion having a leading edge, a trailing edge, a concave pressure side, a convex suction side, a base section and a tip section;

a plurality of second rotor blades including a closing blade, each second blade having a platform portion with upper and lower surfaces, a straight side-entry root portion extending downwardly from the lower surface of the platform portion and mounting the plurality of second rotor blades in alternating relation with respect to the first rotor blades, and a freestanding airfoil portion extending upwardly from the upper surface of the platform portion, the airfoil portion having a leading edge, a trailing edge, a concave pressure side, a convex suction side, a base section and a tip section;

wherein the platform portions of all but the starting blade of the first rotor blades, and the platform portions of all of the second rotor blades include a steam inlet side and a steam outlet side, a first end on the concave, pressure side of the airfoil portion at the base section and a second end on the convex, suction side of the airfoil portion at the base section, wherein the steam outlet side of the platform portion includes a wing extending outwardly from the first end of the platform portion and a cut out, having a shape substantially corresponding to the shape of the wing, on the second end of the platform portion, the trailing edge of the airfoil portion at the base section being supported by the wing, wherein the platform portion of the starting one of the first rotor blades has a steam inlet side and a steam outlet side, a first end on the concave, pressure side of the airfoil portion at the base section and a second end on the concave, suction side of the airfoil portion at the base section, and a cut out formed in the second end of the platform portion at the steam outlet side thereof, and a locking pin interconnecting the closing blade and a proceeding one of the first blades at their adjacent platform portions, and wherein the base section of each of the second rotor blades has an airfoil maximum thickness dimension that is less than an airfoil maximum thickness dimension of the base section of each of the first rotor blades, and wherein the tip section of each of the first and second rotor blades has a profile and the profile of the second rotor blades is shorter in the longitudinal direction of the blade than the profile of the first rotor blades, the base section relatively thinner maximum thickness and shorter profile length of the second rotor blades resulting in a lower resonant frequency for the second rotor blades compared to the first rotor blades.

4. A freestanding, rotating blade mounted on a turbine rotor, said blade having a structure in accordance with the following table:

BASIC BLADE SECTION COORDINATE POINTS

| Section | 1 | 2 | 3 | 4 | 5 | 6 | 7 | 8 | 9 | 10 | 11 |
|---|---|---|---|---|---|---|---|---|---|---|---|
| | | | | | CONVEX HORIZONTAL | | | | | | |
| A-A | −.5570 | −.4860 | −.4150 | −.3540 | −.2870 | −.2110 | −.1190 | −.0020 | −.1460 | .3440 | .6790 |
| B-B | −.7050 | −.6743 | −.5400 | −.4480 | −.3460 | −.2290 | −.0940 | −.0690 | −.2770 | .5290 | .9030 |
| C-C | −.8240 | −.7310 | −.6300 | −.5170 | −.3860 | −.2340 | −.0570 | −.1540 | −.4010 | .6630 | .9000 |
| D-D | −.9740 | −.9610 | −.7330 | −.5850 | −.4160 | −.2230 | −.0030 | −.2500 | −.5190 | .7660 | .9730 |
| E-E | −1.1010 | −.9613 | −.8019 | −.6187 | −.4108 | −.1761 | −.0881 | −.3690 | −.6387 | .9737 | 1.0728 |
| | | | | | CONVEX VERTICAL | | | | | | |
| A-A | −1.3910 | −1.1280 | −.9690 | −.6090 | −.3490 | −.0520 | .1600 | .4010 | .6250 | .8050 | .9260 |
| B-B | −1.1910 | −.9410 | −.6950 | −.4530 | −.2150 | −.0160 | .2370 | .4390 | .5940 | .6540 | .5460 |
| C-C | −1.0670 | −.8160 | −.5730 | −.3360 | −.1070 | −.1070 | .3020 | .4590 | .5470 | .5240 | .3560 |
| D-D | −.9150 | −.6640 | −.4280 | −.2030 | −.0060 | −.1930 | .3470 | .4390 | .4390 | .3340 | .1280 |
| E-E | −.7774 | −.5245 | −.2921 | −.0778 | −.1125 | −.7688 | .3671 | .3763 | .3763 | .1362 | .0921 |

| Section | 12 | 13 | 14 | 15 | 16 | 17 | 18 | 19 | 20 | 21 | 22 | 23 |
|---|---|---|---|---|---|---|---|---|---|---|---|---|
| | | | | | CONCAVE HORIZONTAL | | | | | | | |
| A-A | −.5570 | −.4120 | −.3240 | −.2350 | −.1430 | −.0470 | .0560 | .1680 | .2940 | .4460 | .6780 | — |
| B-B | −.7050 | −.5480 | −.4450 | −.3380 | −.2770 | −.1090 | .0190 | .1600 | .3190 | .5080 | .8030 | — |
| C-C | −.8240 | −.6510 | −.5300 | −.4030 | −.2770 | −.1280 | .0250 | .1940 | .3830 | .5930 | .9000 | — |
| D-D | −.9740 | −.7850 | −.6420 | −.4900 | −.3290 | −.1570 | .0380 | .2310 | .4450 | .6640 | .9730 | — |
| E-E | −1.1010 | −.8931 | −.7268 | −.5469 | −.3527 | −.1445 | .0764 | .3054 | .5353 | .7590 | 1.0728 | — |
| | | | | | CONCAVE VERTICAL | | | | | | | |
| A-A | −1.5620 | −1.1710 | −.9370 | −.7040 | −.4710 | −.2400 | −.0130 | .2110 | .4270 | .6250 | .7990 | −1.4248 |
| B-B | −1.3240 | −1.0100 | −.8120 | −.6170 | −.4230 | −.2340 | −.0510 | .1220 | .2770 | .3960 | .4290 | −1.2256 |
| C-C | −1.1780 | −.9040 | −.7210 | −.5430 | −.3690 | −.2020 | −.0450 | .0840 | .2050 | .2670 | .2320 | −1.1024 |
| D-D | −1.0100 | −.7670 | −.6010 | −.4430 | −.2940 | −.1590 | −.0440 | .0420 | .0900 | .0890 | −.0020 | −.9504 |
| E-E | −.8673 | −.6336 | −.4741 | −.3301 | −.2061 | −.1074 | −.0420 | .0162 | −.0323 | .0874 | −.2292 | −.8144 |

5. A rotating blade for a steam turbine comprising:

a platform portion having upper and lower surfaces;

a straight side-entry root portion extending downwardly from the lower surface of the platform portion; and a freestanding airfoil portion extending upwardly from the upper surface of the platform portion, wherein the airfoil portion has a leading edge, a trailing edge, a concave pressure side, a convex suction side, a base section and a tip section, wherein the platform portion has a steam inlet side and a steam outlet side, a first end on the concave, pressure side of the airfoil portion at the base section and a second end on the convex, suction side of the airfoil portion at the base section, wherein the steam outlet side of the platform portion includes a wing extending outwardly from the first end of the platform portion and a cut out, having a shape substantially corresponding to the shape of the wing, on the second end of the platform portion, the trailing edge of the airfoil portion at the base section being supported by the wing, and wherein the blade has a resonant frequency in a first vibratory mode, corresponding to a tangential vibration in a rotational direction of a rotor on which the blade is to be mounted when the rotor is operated at a running speed, which is substantially between a third and fourth harmonic of the running speed, and the blade has a resonant frequency in a second vibratory mode, corresponding to a vibration in an axial direction of the rotor when the rotor is operated at the running speed, which is substantially midway between a seventh and eighth harmonic of the running speed, said blade having a structure in accordance with the following table:

BASIC BLADE SECTION COORDINATE POINTS

| Section | 1 | 2 | 3 | 4 | 5 | 6 | 7 | 8 | 9 | 10 | 11 | |
|---|---|---|---|---|---|---|---|---|---|---|---|---|
| | | | | | CONVEX HORIZONTAL | | | | | | | |
| A-A | −.5570 | −.4860 | −.4150 | −.3540 | −.2870 | −.2110 | −.1190 | −.0020 | −.1460 | .3440 | .6790 | |
| B-B | −.7050 | −.6743 | −.5400 | −.4480 | −.3460 | −.2290 | −.0940 | −.0690 | −.2770 | .5290 | .9030 | |
| C-C | −.8240 | −.7310 | −.6300 | −.5170 | −.3860 | −.2340 | −.0570 | −.1540 | −.4010 | .6630 | .9000 | |
| D-D | −.9740 | −.9610 | −.7330 | −.5850 | −.4160 | −.2230 | −.0030 | −.2500 | −.5190 | .7660 | .9730 | |
| E-E | −1.1010 | −.9613 | −.8019 | −.6187 | −.4108 | −.1761 | −.0881 | −.3690 | −.6387 | .9737 | 1.0728 | |
| | | | | | CONVEX VERTICAL | | | | | | | |
| A-A | −1.3910 | −1.1280 | −.9690 | −.6090 | −.3490 | −.0520 | .1600 | .4010 | .6250 | .8050 | .9260 | |
| B-B | −1.1910 | −.9410 | −.6950 | −.4530 | −.2150 | −.0160 | .2370 | .4390 | .5940 | .6540 | .5460 | |
| C-C | −1.0670 | −.8160 | −.5730 | −.3360 | −.1070 | −.1070 | .3020 | .4590 | .5470 | .5240 | .3560 | |
| D-D | −.9150 | −.6640 | −.4280 | −.2030 | −.0060 | −.1930 | .3470 | .4390 | .4390 | .3340 | .1280 | |
| E-E | −.7774 | −.5245 | −.2921 | −.0778 | −.1125 | −.7688 | .3671 | .3763 | .3763 | .1362 | .0921 | |
| Section | 12 | 13 | 14 | 15 | 16 | 17 | 18 | 19 | 20 | 21 | 22 | 23 |
| | | | | | CONCAVE HORIZONTAL | | | | | | | |
| A-A | −.5570 | −.4120 | −.3240 | −.2350 | −.1430 | −.0470 | .0560 | .1680 | .2940 | .4460 | .6780 | — |
| B-B | −.7050 | −.5480 | −.4450 | −.3380 | −.2770 | −.1090 | .0190 | .1600 | .3190 | .5080 | .8030 | — |
| C-C | −.8240 | −.6510 | −.5300 | −.4030 | −.2770 | −.1280 | .0250 | .1940 | .3830 | .5930 | .9000 | — |
| D-D | −.9740 | −.7850 | −.6420 | −.4900 | −.3290 | −.1570 | .0380 | .2310 | .4450 | .6640 | .9730 | — |
| E-E | −1.1010 | −.8931 | −.7268 | −.5469 | −.3527 | −.1445 | .0764 | .3054 | .5353 | .7590 | 1.0728 | — |
| | | | | | CONCAVE VERTICAL | | | | | | | |
| A-A | −1.5620 | −1.1710 | −.9370 | −.7040 | −.4710 | −.2400 | −.0130 | .2110 | .4270 | .6250 | .7990 | −1.4248 |
| B-B | −1.3240 | −1.0100 | −.8120 | −.6170 | −.4230 | −.2340 | −.0510 | .1220 | .2770 | .3960 | .4290 | −1.2256 |
| C-C | −1.1780 | −.9040 | −.7210 | −.5430 | −.3690 | −.2020 | −.0450 | .0840 | .2050 | .2670 | .2320 | −1.1024 |
| D-D | −1.0100 | −.7670 | −.6010 | −.4430 | −.2940 | −.1590 | −.0440 | .0420 | .0900 | .0890 | −.0020 | −.9504 |
| E-E | −.8673 | −.6336 | −.4741 | −.3301 | −.2061 | −.1074 | −.0420 | .0162 | −.0323 | .0874 | −.2292 | −.8144 |

* * * * *